United States Patent [19]

McCartney

[11] Patent Number: 4,941,218

[45] Date of Patent: Jul. 17, 1990

[54] SEAT STRUCTURE FOR EASY ACCESS TO BATHTUBS

[76] Inventor: Clyde B. McCartney, Box 64, Big Stone City, S. Dak. 57216

[21] Appl. No.: 305,438

[22] Filed: Feb. 3, 1989

[51] Int. Cl.[5] ..... A47K 3/12

[52] U.S. Cl. ..... 4/579; 4/578

[58] Field of Search ..... 4/579, 578, 590, 589, 4/584, 573, 571, 560, 547, 611, 546, 548, 555, 559

[56] References Cited

U.S. PATENT DOCUMENTS

| | | | |
|---|---|---|---|
| 657,640 | 9/1900 | Brown | 4/579 |
| 1,805,297 | 5/1931 | Sadusky et al. | 4/579 |
| 2,045,110 | 6/1936 | Spiess | 4/562 |
| 2,142,434 | 1/1939 | Bentz | 4/579 |
| 2,237,076 | 4/1941 | Kenney et al. | 4/579 |
| 3,022,518 | 2/1962 | Hayden | 4/562 |
| 3,203,008 | 8/1965 | Murcott | 4/561 |
| 3,624,666 | 11/1971 | Higgins | 4/562 |
| 3,718,365 | 2/1973 | Gibson | 297/249 |
| 4,168,549 | 9/1979 | Davies | 4/578 |
| 4,373,221 | 2/1983 | Wilson | 4/589 |
| 4,837,871 | 6/1989 | Wheeler | 4/572 |

FOREIGN PATENT DOCUMENTS

| | | | |
|---|---|---|---|
| 2520998 | 8/1983 | France | 4/548 |
| 2119241 | 11/1983 | United Kingdom | 4/579 |

*Primary Examiner*—Henry J. Recla
*Assistant Examiner*—Edward Donovan
*Attorney, Agent, or Firm*—Kinney & Lange

[57] ABSTRACT

A seat structure for providing easy access to bathtubs includes a seat platform retainer bracket having a top, horizontally extending, J-shape platform-retaining hook portion fastened along the top edge of a bathtub wall; a seat platform which is supported on the opposite side top edges of a bathtub; and a seat which is pivotally mounted on a vertical axis to the seat platform through the use of a pivot peg extending into both the seat and platform. The seat platform has an upstanding boss along its side adjacent to the retainer bracket, and when the structure is in use, the boss is in the hook portion of the retainer bracket to prevent any movement of the platform while it is supported on top of the tub.

5 Claims, 3 Drawing Sheets

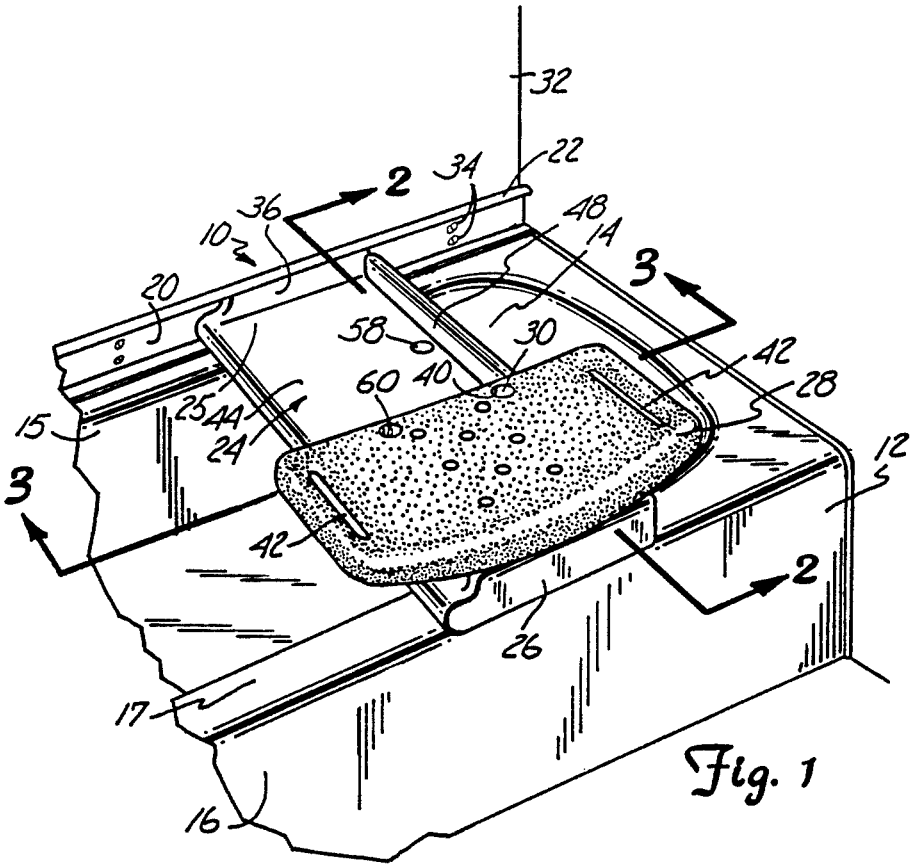
Fig. 1
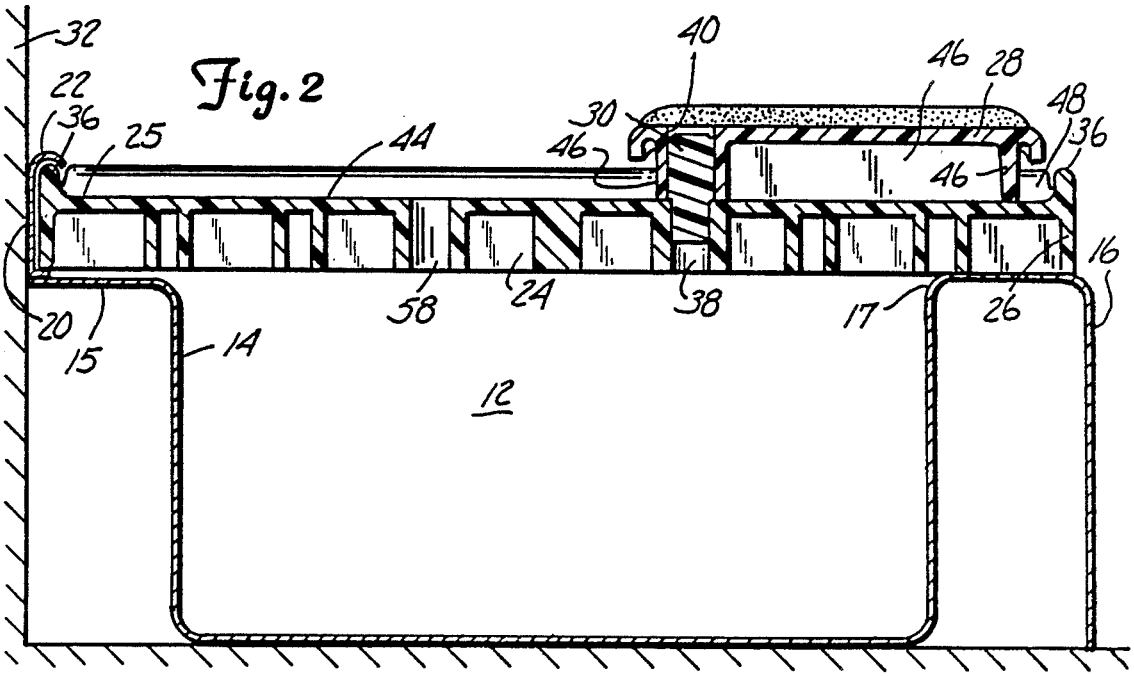

SEAT STRUCTURE FOR EASY ACCESS TO BATHTUBS

BACKGROUND OF THE INVENTION

1. Field of the Invention.

The emphasis in recent months and years has been to leave elderly persons in their own homes rather than to provide care for them in public facilities where husky attendants and expensive and sophisticated equipment is available to meet their needs. This has resulted in many married couples and other groups of elderly persons living by themselves in single family dwellings attempting to take care of themselves without any substantial or regular outside assistance.

This invention has relation to structures for allowing persons without full physical abilities to enter and leave a bathtub safely with the help of but one attendant.

2. Description of Prior Art.

Many structures have been proposed for supporting chairs or seats above and/or within bathtubs to help persons who cannot enter and leave bathtubs unaided. These include structures which are designed to be permanently mounted to tubs such as shown in U.S. Pat. No. 2,045,110 granted to Spiess on June 23, 1936 and U.S. Pat. No. 3,624,666 granted to Higgins on Nov. 30, 1971. Such structures have the distinct disadvantage that the use of the tub is more or less dedicated to the use of the person needing the aid; and a spouse or other persons in the same household must go elsewhere or "put up with" this installation in order to use the same bathtub.

Bath chair structures have been devised which must be laboriously fastened in place each time the handicapped person is to use the tub, and must be just as laboriously unfastened and removed before another household occupant can have unfettered use of the tub. Such structures are shown in the following U.S. Pat. Nos. 3,203,008 granted to Murcott on Aug. 31, 1965; 3,022,518 granted to Hayden on Feb. 27, 1962; 2,142,434 granted to Bentz on Jan. 3, 1939; 1805,297 granted to Sadusky on May 12, 1931. Also adaptable for use in this same manner is the teaching of U.S. Pat. No. 3,718,365 to Gibson for a SEAT ATTACHMENT FOR BOATS, granted Feb. 27, 1973.

Some structures have been devised which include a platform and a chair rotatably but also slidably mounted on a platform and which is merely set on top of a bathtub. These rely on the force of gravity to hold them in place; and tend to be, or at least to feel, less stable than structures where the framework or platform is fixed and the chair does not slide. See, for example, U.S. Pat. No. 2,237,076 to Kenney et al, granted Apr. 1, 1941. Another simple bathtub seat which is merely set in place on hooks overhanging the edge of the bathtub is the ancient U.S. Pat. No. 657,640 to Brown, granted Sept. 11, 1900.

None of these patents, and no prior art or combination of prior art known to the present inventor and those in privity with him will allow, for example, one of two married people to assist the other into and out of a bathtub safely without having to, at some point, lift or support substantially the full weight of the other person in the process.

The patents cited above do show structures which are designed to allow a person with a physical disability to sit on a chair with feet over the edge of the tub and then to swing those feet up over the edge of the tub while swiveling around with the chair. However, none show how to accomplish this with the firmness, solidity and rigidity of a permanent installation while still providing that the structure can be easily removed and replaced in order that it be clear of the tub when it is not needed.

The patents discussed above were located during a Patent Office search on the invention set out herein. Neither the inventor nor those in privity with him are aware of any closer prior art or any prior art which anticipates claims made herein.

SUMMARY OF THE INVENTION

This invention presents a seat structure for bathtubs wherein one person can assist another safely into and out of a bathtub without the assistant having to lift any more weight than the feet and lower legs below the knee of the person being assisted. Using this structure, many couples, for example, either or neither of which who are not strong enough or agile enough to safely get into and/or out of a bathtub alone can be easily assisted by the other in so doing. Where the bathing person is sufficiently agile to move from the bathtub seat of the invention to the bottom of the bathtub, the assisting person can lift the light weight of the bathtub seat and then the light weight of a seat platform to entirely remove these from the tub, thus allowing the bathing person the use of the entire tub. When bathing has been completed, the bathing person has but to move toward the far end of the tub, and the assisting person can lift and fasten the platform and then the seat back into position. Then, if the bathing person has some substantial upper body strength, the assistant, can, using the buoyancy of a full tub of water, for example, help the bathing person to be repositioned on the seat. Then the assistant can help the bathed person by lifting feet and lower legs to the height of the bathtub and swinging the person and the seat into position for safely leaving the tub.

The easy access seat structure for permitting easy access to a bathtub having mutually parallel, spaced-apart, horizontal side wall top edge portions lying in the same horizontal plane includes a retainer bracket, a seat platform and a seat.

The retainer bracket is fixedly mounted in parallel, adjacent relation to and above the top edge portion of a first of the tub side walls. The bracket has a top platform-retaining portion open in direction toward the center of the tub. In the form of the invention shown, this retaining portion is constituted as a horizontally extending, J-shape, platform-retaining hook portion which extends outwardly and downwardly toward the center of the tub.

The seat platform is of size and shape to have first and second side edge portions capable of resting on and being supported by the top edge portions of both of the tub side walls at the same time.

The seat is pivotally mounted on a vertical axis with respect to the platform to be movable through an arc of about ninety degrees between first and second seat positions. The seat when it is in the first seat position is situated to be accessible for sitting by a person outside of the tub, adjacent to a second of the tub side walls and facing away from the tub. When in the second seat position, the seat is situated to support a seated person substantially centered over the tub with that person's feet within the tub.

The configuration of the seat and platform are such that the seat is solidly supported with respect to the platform in a horizontal plane during the entire movement of the seat between its first and second positions.

The platform is provided with a boss forming a part of at least one of the platform side edge portions. The configuration of the platform boss and the bracket is such that the platform boss can be inserted into, and removed from anywhere along the platform-retaining portion of the retainer bracket as platform is moved to angles acute to the horizontal. The platform-retaining portion of the bracket prevents any motion of the boss and its platform in direction normal to the side walls of the tub when the boss is held within the platform-retaining portion and the platform is in its horizontal position supported by the tub side walls, while permitting sliding movement of the platform along the bracket when the platform is not unduly loaded.

In the form of the invention as shown, the bracket, including the hook portion, is such that the platform boss can be inserted into, and removed from, the bracket hook portion as the platform is moved to such angles acute to the horizontal.

BRIEF DESCRIPTION OF THE DRAWINGS

FIG. 1 is a perspective view of one form of a seat structure for easy access to a bathtub with a seat shown in a first position to be accessible for sitting by a person outside of the tub;

FIG. 2 is an enlarged vertical sectional view taken on the line 2—2 in FIG. 1;

DETAILED DESCRIPTION OF PREFERRED EMBODIMENT

Figure 3:
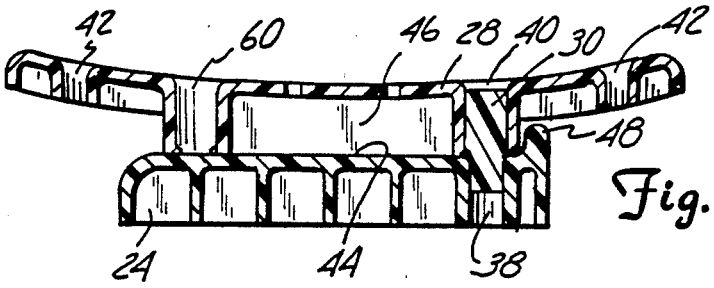
FIG. 3 is an enlarged vertical sectional view of the seat and its platform taken on the line 3—3 in FIG. 1.

A seat structure 10 for easy access to a bathtub is shown herein in connection with a bathtub 12 having a first side wall 14 terminating in a first side wall top edge portion 15 and a second side wall 16 terminating in a second side wall top edge portion 17.

The seat structure 10 includes a seat platform retainer bracket 20 having a top, horizontally extending, J-shape platform-retaining hook portion 22; a seat platform 24 having a first side edge portion 25 and a second side edge portion 26, each supported by a top edge portion 15 or 17 of one of the side walls 14 and 16; and a seat 28 pivotally mounted on a vertical pivot axis to the seat platform 24 by a pivot peg 30.

Figure 4:
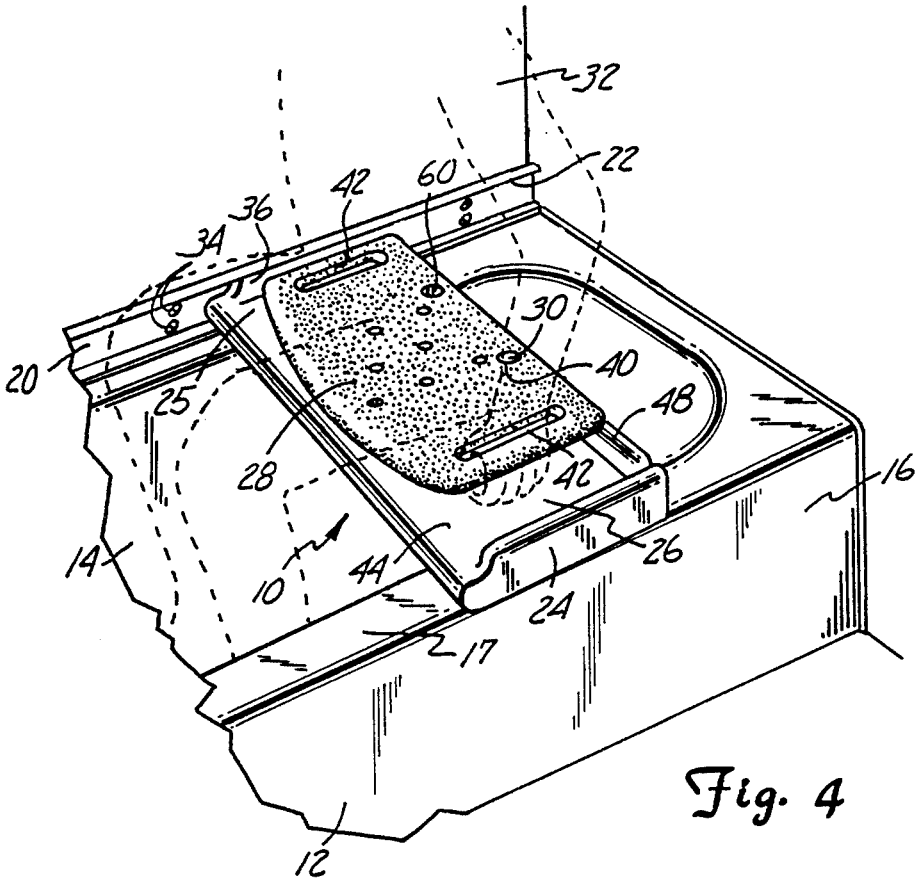
FIG. 4 is a perspective view similar to FIG. 1 but showing the seat in a second position situated to supported a seated person substantially centered over the tub and with that person's feet within the tub.
Figure 5:
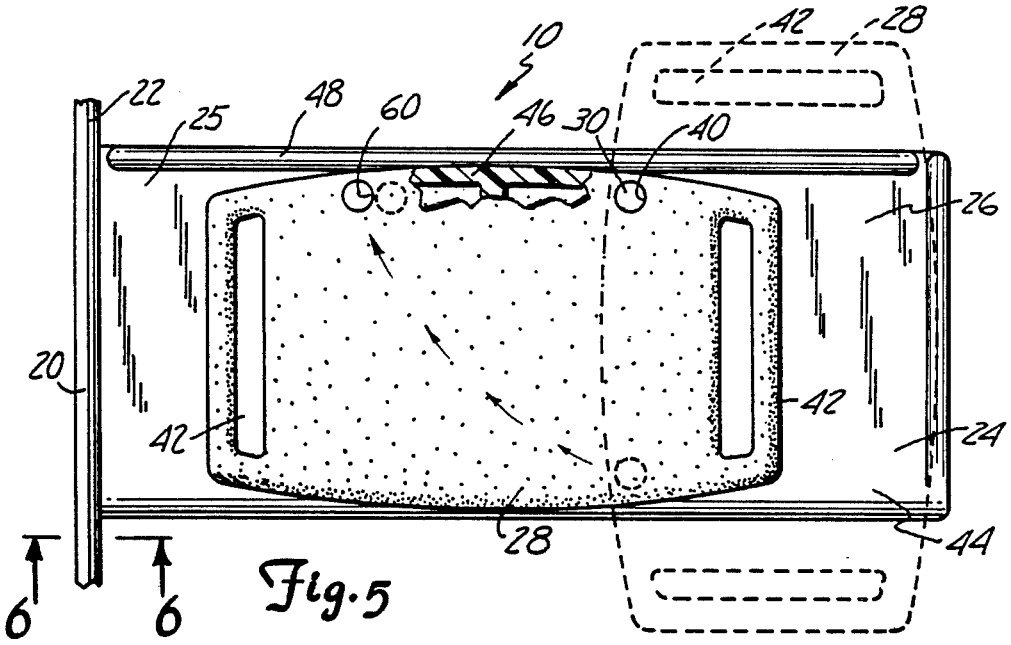
FIG. 5 is a top plan view of the structure of the invention with the seat shown in full lines in its second position and shown in dotted lines in its first position.
Figure 6:
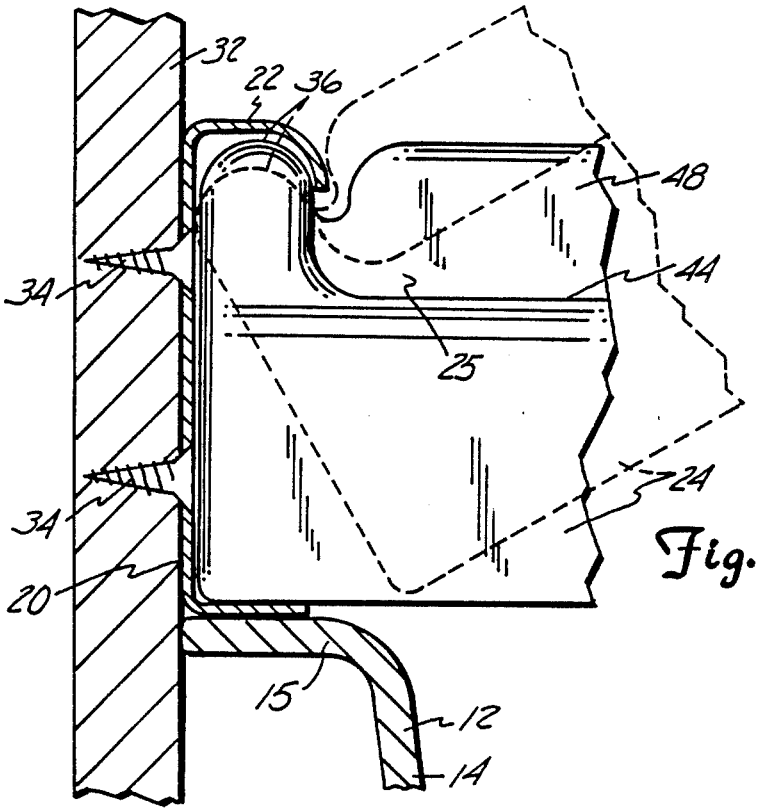
FIG. 6 is an enlarged fragmentary sectional view as if taken on the lines 6—6 in FIG. 5.

The seat platform retainer bracket 20 could be mounted directly to one of the side walls 14 or 16 of the tub 12, but, as most clearly shown in FIG. 6, it is disclosed herein as being mounted to a bathroom wall 32 by screws or other appropriate fasteners 34 to fixedly position the bracket with respect to the first side wall top edge portion 15, as best seen in FIG. 6, and as also seen in FIG. 5, the first side edge portion 25 of the seat platform 24 includes an upstanding boss 36. Preferably the retainer bracket 20 can be permanently mounted with respect to the tub 12; but the seat platform 24 and the seat 28 need be positioned over the tub only when the tub is to be used for a person with movement disability. Only at that time need the seat platform 24 be brought into position over the tub, and moved to have an acute angle with respect to the horizontal, the boss 36 inserted into the hook portion 22 as shown in dotted lines in FIG. 6, and the shelf then brought into supported relationship with respect to the top edge portions 15 and 17 of the tub side walls 14 and 16, respectively, as seen in full lines in FIG. 6. See also FIGS. 1, 2, 4 and 5.

As best seen in FIGS. 2 and 3, seat platform 24 is provided with a pivot hole 38 for receiving pivot peg 30, while seat 28 is provided with a peg receiving hole 40 into which pivot peg 30 is installed. Pivot peg 30 can be force fit into seat peg hole 40. In order that the seat 28 can be easily removed from the seat platform 24 when the structure is to be stored away from the tub, the diameter of peg 30 can be such that it easily but snugly fits into the platform pivot hole 38.

The seat 28 is also provided with a pair of hand holds 42,42 which, during movement of the seat from its first to its second position as described below, the person seated on the seat can use in a manner as suggested by the phantom figure shown in FIG. 4.

Seat platform 24 is provided with a flat upper seat-supporting surface 44; and seat 28 is provided with a downwardly extending skirt 46 around the entire periphery of the outer edge portions of the seat. Skirt 46 terminates in a horizontal plane and, at all times that the seat structure 10 is assembled for use, rests on or rides on the seat-supporting surface 44 of the seat platform 24.

The seat platform 24 and/or the seat 28 can be made of any one of a large number of suitable materials. For example, early prototypes of the invention were fabricated from wood. However, for production, fabricating of these two elements from polypropylene has been found to be satisfactory. In addition to the various webs extending downwardly from the flat plate defined by the surface 44, designed to give the seat platform more than enough strength and warp resistance to serve its purpose, the seat platform 24 is also provided with an upwardly extending rear stop wall or bead 48. As seen in FIG. 3, the downwardly extending seat skirt 46 contacts this bead 48 to prevent rotation in counterclockwise direction of the seat 28 beyond its position as seen in FIGS. and 3. Similarly, this stop bead 48 prevents further rotation of the seat in counterclockwise direction beyond its position as seen in FIGS. 4 and 5.

OPERATION

In order to safely bathe a person not capable or willing to enter or leave a bathtub without help, the seat structure of the invention will be assembled. The seat platform 24 will be installed at a convenient position near one end of the bathtub 12 by holding it at an acute angle with respect to the horizontal and sliding its boss 36 up into the J-shape hook portion 22 of the seat platform retainer bracket 20 and then lowering it to a horizontal position supported by the side walls of the tub. Next to the seat 28, with pivot peg 30 installed, will be moved to position over the platform 24 as illustrated in FIG. and the peg 30 inserted into the platform pivot hole 38 as illustrated in FIG. 3. With the seat 30 in its first position as seen in FIGS. 1 and 2, the person to be bathed can be assisted to sit on the seat with legs extending toward or to the bathroom floor.

With the seated person holding firmly to the hand holds 42,42, the assistant can raise that person's feet so that the heels are above the height of the side wall 16 of the tub, and can then rotate the person and the seat around the vertical axis of pivot peg 30 until the seat reaches its second position as seen in FIG. 4. The feet and lower legs of the seated person can then be lowered into the tub.

The seated person can be sponged off in this position or, if physical abilities permit, can move forward in the tub to be momentarily clear of the seat and platform. The assistant can rapidly raise the platform through the position shown in dotted lines in FIG. 6 and remove it from the tub. The person in the tub can now have the use of the entire tub in a more or less normal manner.

When the bath is over, the person in the tub can again move toward the far end of it and the assistant can reinstall the platform and seat, assist the now bathed person to a position on the seat as suggested in dotted lines in FIG. 4, lift the legs and feet high enough to clear the tub side wall 16, and rotate the person in the seat to position of the seat as seen in FIGS. 1, 2 and 3.

The bathed person can then be dried off and assisted away from the tub using a wheelchair or such other aids as may be necessary.

To accommodate use in connection with a bathtub resting up against a wall on the opposite side, in addition to the platform pivot hole 38, a second platform pivot hole 58 is also provided in the platform. See FIGS. 1 and 2. Similarly, in addition to the seat peg hole 40 for receiving the pivot peg 30, a second seat peg hole 60 is provided in the seat. See FIGS 1, 3, 4 and 5. To mount the seat structure 10 of the invention for use from the opposite side, it is only necessary that seat platform retainer bracket 2 be installed along the second side wall 16, the pivot peg 30 be driven into the second seat peg hole 60, and then, at the appropriate time, this seat peg 30 be inserted into the second platform pivot hole 58.

Although the present invention has been described with reference to preferred embodiments, workers skilled in the art will recognize that changes may be made in form and detail without departing from the spirit and scope of the invention.

What is claimed is:

1. The combination of an elongate bathtub having mutually parallel, spaced apart, horizontal top surfaces lying in the same horizontal plane and an easy access seat structure; said easy access seat structure including:

a. an elongate retainer bracket fixedly mounted in parallel adjacent relation to and above the top surface of a first of said tub top surfaces, said bracket having a vertically extending, inverted J-shape cross-section defining a platform-retaining hook portion extending outwardly and downwardly toward the center of the tub, said hook portion extending along the first tub top surface for at least a substantial portion of the length of the tub;

b. a seat platform adapted to have first and second side edge portions capable of resting on and being supported by the top surfaces of both of the tub top surfaces at the same time;

c. a seat pivotally mounted on a fixed vertical axis with respect to the platform to be movable with respect to the platform only through an arc of about ninety degrees between first and second seat positions, the seat when in first seat position being situated to be accessible for sitting by a person outside of the tub adjacent to a second of said tub top surfaces and facing away from the tub, and when in second seat position being situated to support a seated person substantially centered over the tub with that person's feet in the tub;

d. the configuration of the seat and platform being such that the seat is solidly supported with respect to the platform in a horizontal plane during the entire movement of the seat between its first and its second position; and e. wherein the platform is provided with a boss forming a part of at least one of the platform side edge portions, the configuration of the platform boss and the bracket including the hook portion being shaped such that the platform boss can be inserted into, and removed from, any convenient position along the bracket hook portion as the platform is moved to angles acute to the horizontal, and the bracket including the hook portion prevents any motion of the boss and its platform from a direction normal to the top surfaces of the tub when the boss is in the bracket hook portion and the platform is in its horizontal position supported by the tub top surfaces, while permitting sliding movement of the platform along the bracket when the platform is not unduly loaded.

2. The combination as specified in claim 1 wherein:

f. the seat is provided with hand holds on its side edge portions in position to be grasped and held by a person seated on it.

3. The combination of an elongate bathtub having mutually parallel, spaced-apart, horizontal top surfaces lying the same horizontal plane and an easy access seat structure; said easy access seat structure including:

a. a retainer bracket fixedly mounted in parallel adjacent relation to and above the top surface of a first of said tub top surfaces, said bracket having a vertically extending, inverted J-shape cross section defining a platform retaining hook portion extending outwardly and downwardly toward the center of the tub;

b. a seat platform adapted to have first and second side edge portions capable of resting on and being supported by the top surfaces of both of the tub top surfaces at the same time;

c. a seat pivotally mounted on a vertical axis with respect to the platform to be movable through an arc of about ninety degrees between first and second seat positions, the seat when in first seat position being situated to be accessible for sitting by a person outside of the tub adjacent to a second of said tub top surfaces and facing away from the tub, and when in second seat position being situated to support a seated person substantially centered over the tub with that person's feet in the tub;

d. the configuration of the seat and platform being such that the seat is solidly supported with respect to the platform in a horizontal plane during the entire movement of the seat between its first and its second position; and e. wherein the platform is provided with a boss forming a part of at least one of the platform side edge portions, the configuration of the platform boss and the bracket including the hook portion being shaped such that the platform boss can be inserted into, and removed from, the bracket hook portion as the platform is moved to angles acute to the horizontal, and the bracket including the hook portion prevents any motion of the boss and its platform from a direction normal to the bracket and top surfaces of the tub when the boss is in the bracket hook portion and the platform is in its horizontal position supported by the tub top surfaces; and f. wherein the seat platform is provided with a platform pivot hole concentric with the vertical pivot axis of the seat with respect to the platform, and a pivot peg extends downwardly from the seat on that axis and is of dimension to fit snugly into the platform pivot hole; and g. wherein the positioning of the pivot peg with respect to the seat and of the platform pivot hole with respect to the platform is offset from the center of the tub in direction toward the side of the tub away from the retainer bracket when the seat is in the seat position.

4. The combination as specified in claim 3 wherein:

h. the seat is provided with a first seat peg hole, and the pivot peg is mounted to the seat by inserting it into this seat peg hole;

i. the platform is provided with a second platform pivot hole, and the seat is provided with a second seat peg hole each set off from the center of the tub in direction toward the bracket retainer when the seat is in the second seat position so that the easy access seat structure can be adapted for use in a tub where the first of the tub side walls stands free, and the tub is associated with a second of the tub side walls by mounting the retainer bracket fixedly in parallel adjacent relation to the second of the tub side walls and by inserting the pivot pin in the second peg seat hole and in the second platform pivot hole.

5. The combination of an elongate bathtub having mutually parallel, spaced-apart, horizontal top surfaces lying in the same horizontal plane and an easy access seat structure; said easy access seat structure including:

a. an elongate, horizontally extending, retainer bracket fixedly mounted in parallel adjacent relation to and above the top surface of a first of said tub top surfaces, said bracket having a platform-retaining portion which extends at least a substantial distance along the first tub to surfaces;

b. a seat platform adapted to have first and second side edge portions capable of resting on and being supported by the top surfaces of both of the tub top surfaces at the same time;

c. a seat pivotally mounted on a fixed vertical axis with respect to the platform to be movable with respect to the platform only through an arc of about ninety degrees between first and second seat positions, the seat when in first seat position being situated to be accessible for sitting by a person outside of the tub adjacent to a second of said tub top surfaces and facing away from the tub, and when in second seat position being situated to support a seated person substantially centered over the tub with that person's feet in the tub;

d. the configuration of the seat and platform being such that the seat is solidly supported with respect to the platform in a horizontal plane during the entire movement of the seat between its first and its second position; and e. wherein the platform is provided with a boss forming a pair of at least one of the platform side edge portions, the configuration of the platform boss and the bracket being shaped such that the platform boss can be inserted into, and removed from, any convenient position along the platform-retaining portion of the retainer bracket as the platform is moved to angles acute to the horizontal, and the platform-retaining portion of the bracket prevents any motion of the boss and its platform from a direction normal to the bracket and top surfaces of the tub when the boss is in the bracket platform-retaining portion and the platform is in its horizontal position supported by the tub top surfaces, while permitting sliding movement of the platform along the bracket when the platform is not unduly loaded.

* * * * *

UNITED STATES PATENT AND TRADEMARK OFFICE

CERTIFICATE OF CORRECTION

PATENT NO. : 4,941,218

DATED : July 17, 1990

INVENTOR(S) : Clyde B. McCartney

It is certified that error appears in the above-identified patent and that said Letters Patent is hereby corrected as shown below:

Col. 8, line 4, after "tub", delete "to" and insert --top--

Col. 8, line 26, delete "pair", insert --part--

Signed and Sealed this

Thirty-first Day of December, 1991

*Attest:*

HARRY F. MANBECK, JR.

*Attesting Officer*

*Commissioner of Patents and Trademarks*